US007574827B2

(12) United States Patent
Huang et al.

(10) Patent No.: US 7,574,827 B2
(45) Date of Patent: Aug. 18, 2009

(54) LOUVER BLADE POSITIONING DEVICE OF MOTORIZED SHUTTER ASSEMBLY

(75) Inventors: Horng Tsann Huang, Hsinchu (TW); Ching Hwa Lin, Hsinchu (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 11 days.

(21) Appl. No.: 11/878,107

(22) Filed: Jul. 20, 2007

(65) Prior Publication Data

US 2008/0244979 A1 Oct. 9, 2008

(30) Foreign Application Priority Data

Apr. 4, 2007 (TW) ..... 96205563 U

(51) Int. Cl.
*E06B 7/086* (2006.01)

(52) U.S. Cl. ..... 49/90.1; 49/74.1; 49/82.1; 49/403

(58) Field of Classification Search ..... 49/74.1, 49/82.1, 89.1, 90.1, 403
See application file for complete search history.

(56) References Cited

U.S. PATENT DOCUMENTS 207,026 A * 8/1878 Fuller ..... 292/345
3,537,331 A * 11/1970 Rifkin ..... 74/528
3,954,023 A * 5/1976 Perez-Aguilar ..... 74/533
4,926,599 A * 5/1990 Scholz ..... 49/87.1
6,250,012 B1 * 6/2001 Ricci ..... 49/87.1

* cited by examiner

*Primary Examiner*—Jerry Redman
(74) *Attorney, Agent, or Firm*—Birch, Stewart, Kolasch & Birch, LLP

(57) ABSTRACT

A louver blade positioning device of a motorized shutter assembly includes an indented positioning portion or a protruded portion formed upon a driving shaft and a resilient member coming into contact with the driving shaft and the indented positioning portion or the protruded portion in a radically movable manner at a fixed angle. When the louver blades are rotated to approach a specific angle, the resilient member moves into the indented positioning portion or the protruded portion. Through the resilient force exerted by the resilient member on the indented positioning portion or the protruded portion, the driving shaft rotates to approach the specific angle, such that the louver blades become positioned at the specific angle when being rotated to approach the specific angle, thereby becoming free from the angular clearance inherent among transmission components of the motorized shutter assembly.

10 Claims, 8 Drawing Sheets

LOUVER BLADE POSITIONING DEVICE OF MOTORIZED SHUTTER ASSEMBLY

BACKGROUND OF THE INVENTION

1. Field of the Invention

The present invention relates to a device for a motorized shutter assembly, particularly a motorized shutter assembly with a louver blade positioning device.

2. Description of the Prior Art

Referring to FIG. 1A, a conventional motorized shutter assembly 11 primarily includes a plurality of louver blades 13 and a push rod 12 driven by a motorized module 10 in order to drive the plurality of louver blades 13 in linkages and to adjust an angle of louver blades in a motorized manner through a remote control 101.

Referring to FIG. 1B, the motorized module 10 includes a motor 102 and a transmission mechanism 103 to drive in reversible movement of the louver blades 13 through a driving shaft 104. In addition to motorized operations, ordinary motorized shutter assembly can be manually operated by pushing the push rod 12 in order to adjust an angle of louver blades as shown in FIGS. 1C and 1D. However, when one manually pushing the push rod 12 upward to close the plurality of louver blades 13, the louver blades 13 become titled toward Position "b" from the manually closed Position "a" due to the dead weight in response to the weight of the louver blades 13 and the push rod 12 and/or the clearance inherent between elements of the transmission mechanism in the motorized module 10 as shown in FIG. 1D. Consequently, this causes the disadvantage of unsatisfactory manual closure. Moreover, during motorized operations, several sets of motorized shutters may encounter an angular variance under the same control command possibly due to the clearance among the elements.

SUMMARY OF THE INVENTION

The object of the present invention is to provide a motorized shutter assembly with a louver blade positioning device, such that the louver blades can be effectively positioned at a specific angle, for example, full-closed or at a specific angle as desired.

The present invention provides a motorized shutter assembly with a louver blade positioning device, including an indented positioning portion or a protruded portion formed upon a driving shaft for driving louver blades and a resilient member formed on a suitable position of the shutter assembly. The predetermined portion of the resilient member moves toward the driving shaft and is inserted into the indented positioning portion or the protruded portion when the louver blades connected to the driving shaft are rotated to approach a specific angle. Through the resilient force exerted by the resilient member on the indented positioning portion or the protruded portion, the driving shaft rotates to approach a specific angle, such that the louver blades are rotated automatically toward a predetermined angle and become positioned when being rotated to approach the angle, thereby becoming free from the angular clearance among transmission components of the motorized shutter assembly.

The advantage of the present invention is that the louver blades of the louver blade positioning device of the motorized shutter assembly made according to the present invention can automatically be positioned at a specific angle through manual or electrical operations in order to become free from the clearance between the motor and the transmission mechanism. In this way, the louver blades are manually closed tightly or a plurality of louver blades of the motorized shutter assembly is easily positioned at a consistent, specific angle under motorized or manual operations.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE PREFERRED EMBODIMENTS

Figure 1A:
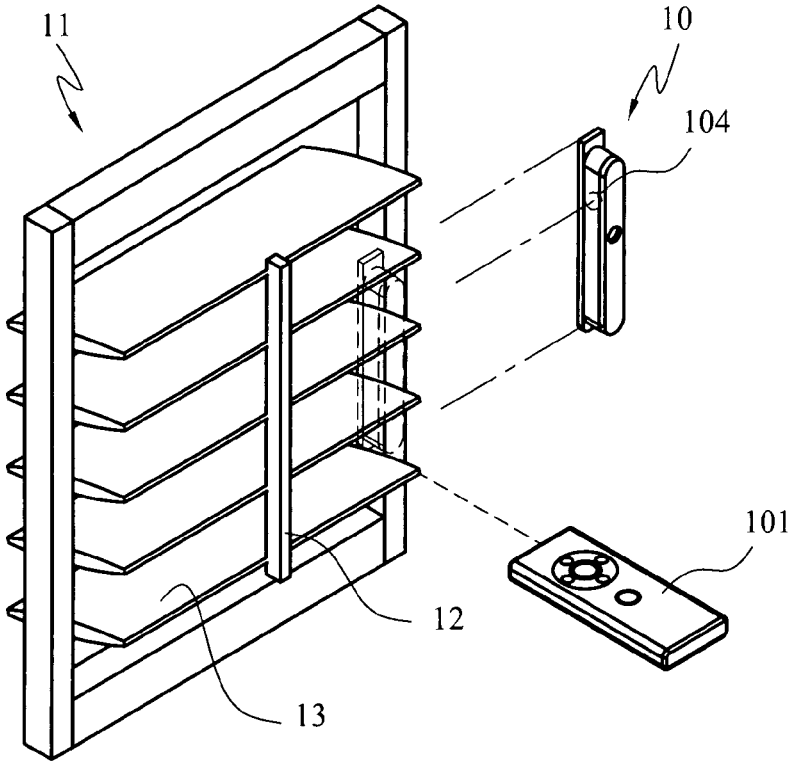
FIG.1A (Prior Art)
FIG. 1A shows a schematic perspective view of a conventional louver blade positioning device of the motorized shutter assembly.
Figure 1B:
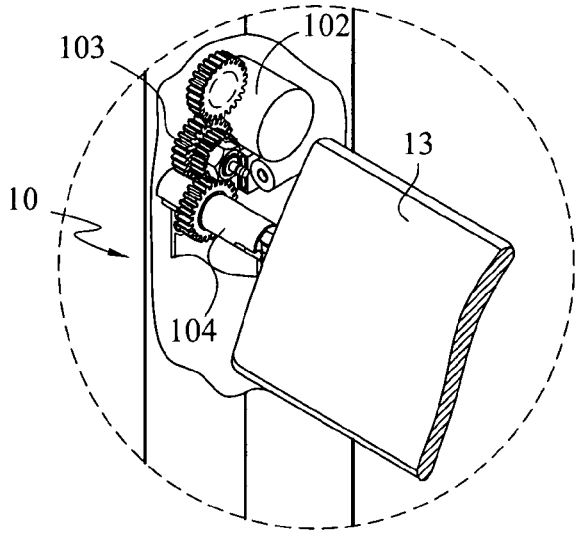
FIG.1B (Prior Art)
FIG. 1B is a schematic view illustrating the structure of the motorized module capable of adjusting louver blades made according to FIG. 1A.
Figure 1C:
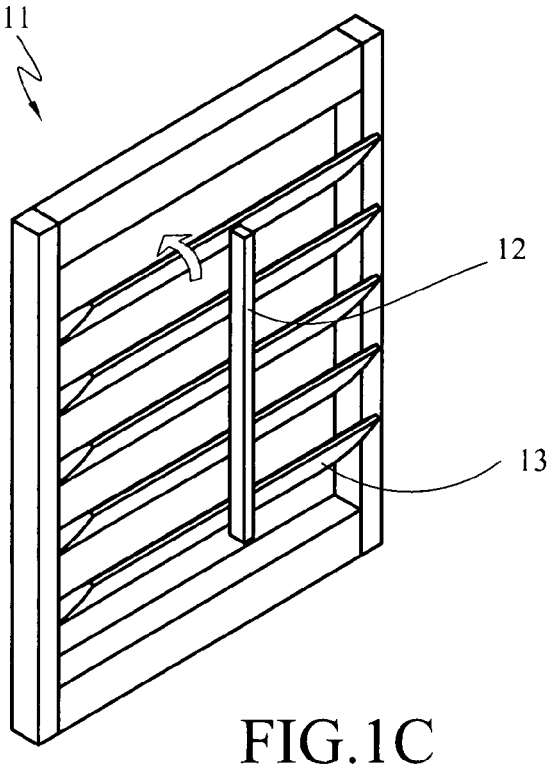
FIG.1C (Prior Art)
FIG. 1C and FIG. 1D are schematic views illustrating the adjusting performance of the louver blade of the motorized module made according to FIG. 1A.
Figure 1D:
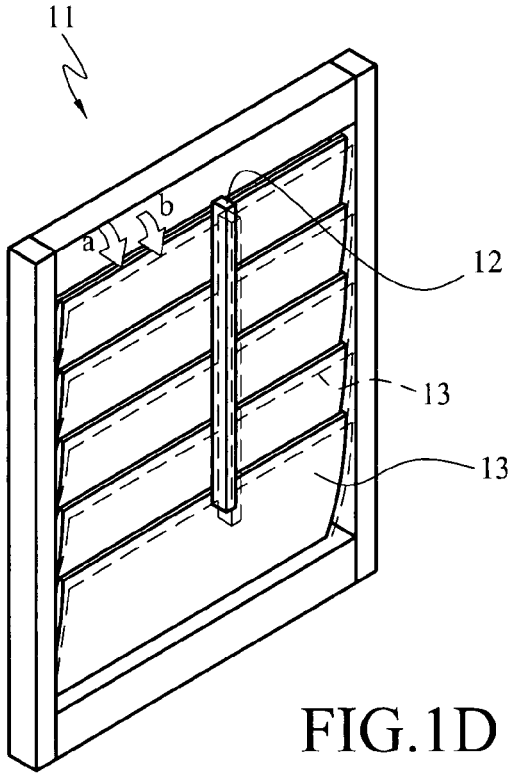
FIG.1D (Prior Art)
Figure 2:
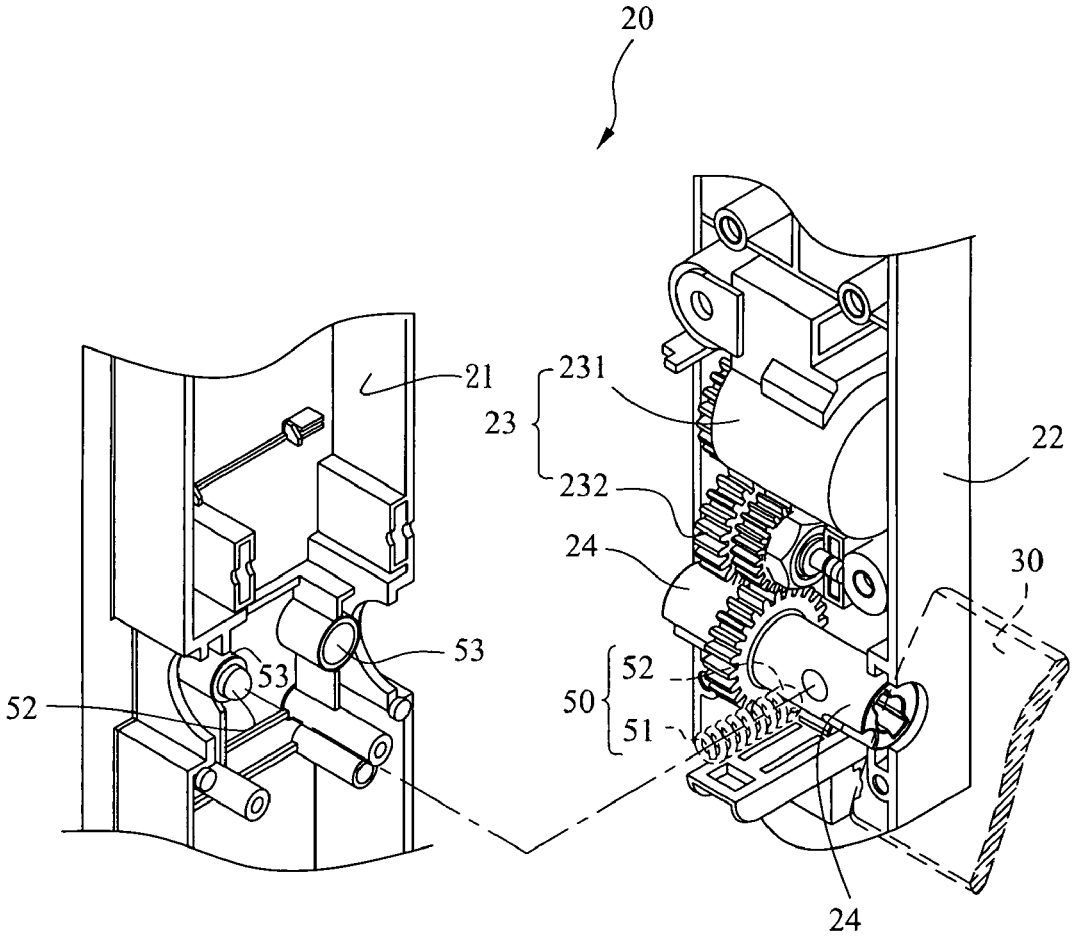
FIG. 2 is a structural view illustrating a first embodiment of the resilient member made according to the present invention.
Figure 3:
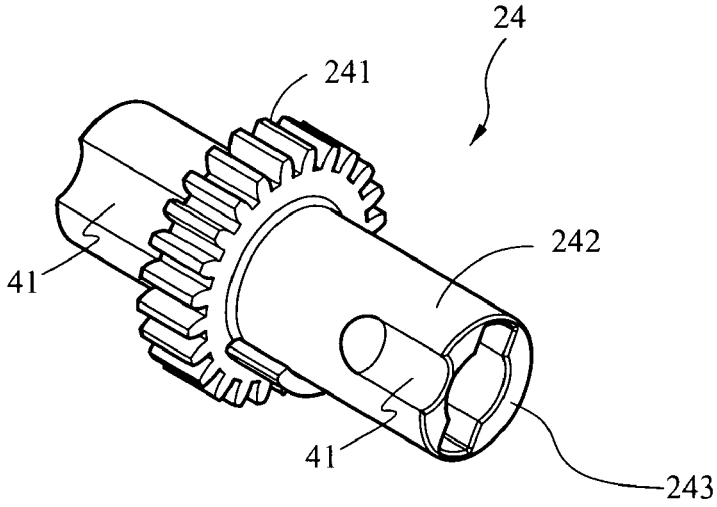
FIG. 3 illustrates a perspective view of a driving shaft made according to FIG. 2.

As shown in FIG. 2 to FIG. 4B, they are schematic views illustrating the structure of a resilient member of a louver blade positioning device of a motorized shutter assembly according to the first embodiment of the present invention. A motorized module 10 of a shutter assembly 11 includes a first housing 21 and a second housing 22 coupled together, housing a transmission mechanism 23, including a motor 231 and a gear 232, as well as a driving shaft 24 therein. In conjunction with the driving shaft 24, a louver blade 30 is driven to rotate. The motor 231 is a direct current, an alternating current or a stepper motor capable of reversible motions, such that the louver blade 30 rotates forward or backward accordingly. The transmission mechanism 23, usually having a torque limiter or a clutch means (not shown in the drawing), facilitates the manual operations and rotations of the louver blade 30, without damaging the motor 231 or the transmission mechanism 23.

To adjust and restore the louver blade 30 and the driving shaft 24 to their respective original positions when approaching a specific angle, the driving shaft 24 of the present invention includes a shaft 242, rotated and pivotally formed between the first housing 21 and the second housing 22, with an end of the driving shaft 24 formed into a louver blade-connecting end 243 capable of connecting a louver blade to another louver blade. A gear 241 formed on an end of the shaft 242 engages with the transmission mechanism 23. One (or more than one) indented positioning portion 41 is arranged and disposed on a circumference of the shaft 242. A set of resilient members 50, formed in a spring slot 53 of the second housing 22, includes an elastic element 51 and an inserted element 52. Constantly being pushed against the elastic member 51, the inserted element 52 moves toward the shaft 242 but it only moves back and forth along a longitudinal axis of the spring slot 53, without departing from the spring slot 53.

In this embodiment, the elastic element 51 is in the form of a helical spring and the inserted element 52 is in the form of a bearing ball. The longitudinal axis of the spring slot 53 is perpendicular to an axis of the driving shaft 24. A guided portion is an arc constituted on a surface of the bearing ball. The longitudinal axis of the spring slot 53 or the movement direction of the inserted element 52 is defined as an included angle not perpendicular (oblique) to an axis of the driving shaft 24 so as not to affect the desirably positioning of the driving shaft 24 at a specific angle.

Figure 4A:
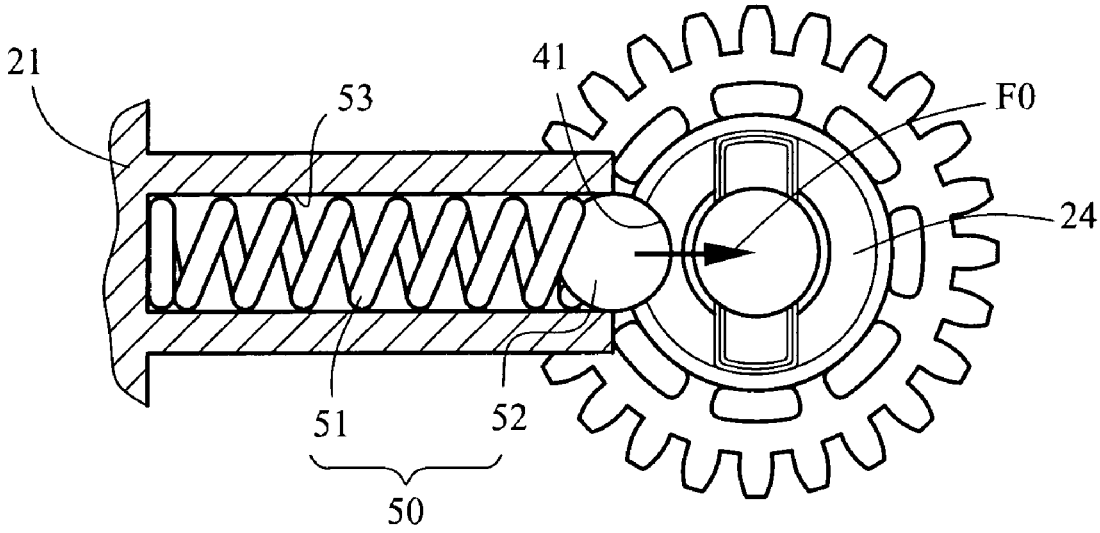
FIGS. 4A and 4B are schematic views illustrating the structure and the function of a resilient member made according to a first embodiment of the present invention.
Figure 4B:
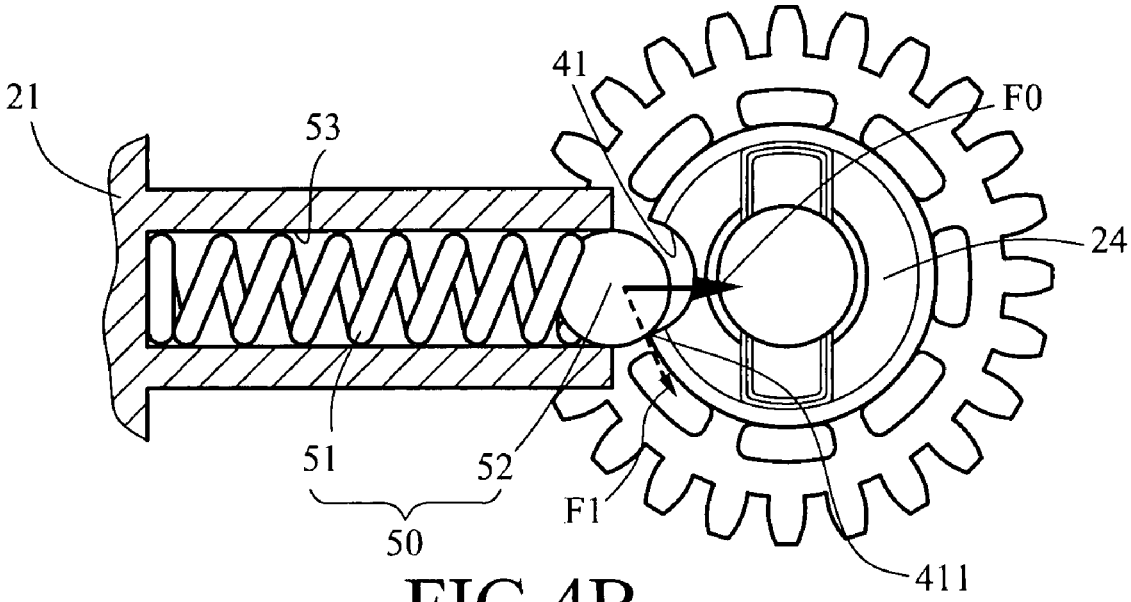

Referring to FIG. 4A, a spring formed in the spring slot 53 pushes against the inserted element 52 such that the spring is exactly inserted into an indented positioning portion 41 of the driving shaft 24, because the force F0 perpendicularly exerted by the spring on the center of rotation of the driving shaft 24 fixes the driving shaft 24 at a predetermined angle.

When the driving shaft 24 rotates to approach the predetermined angle (for example, at the location shown in FIG. 4B) where the motor stops driving, the force F0 exerted by the spring pushes against the inserted element 52, such that the inserted element 52 comes into contact with a contact point 411 on an outer circumference of the driving shaft 24 close to the indented positioning portion 41 through an arc-shaped guided portion. The contact point 411 makes an angle of deflection with the force F0, such that the force F0 produces a component of force F1, driving the driving shaft 24 to rotate and reach a stable positioning state as shown in FIG. 4A. In other words, when the driving shaft 24 rotates to approach the specify angle, the driving shaft 24 automatically becomes positioned.

Figure 5A:
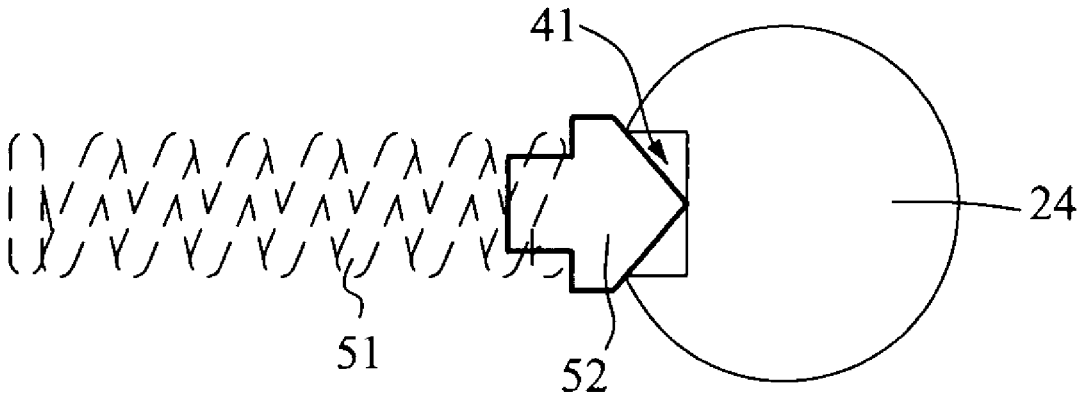
FIG. 5A to FIG. 5E illustrate different configurations of an elastic element and an inserted element of the resilient member made according to the first embodiment of the present invention.
Figure 5B:
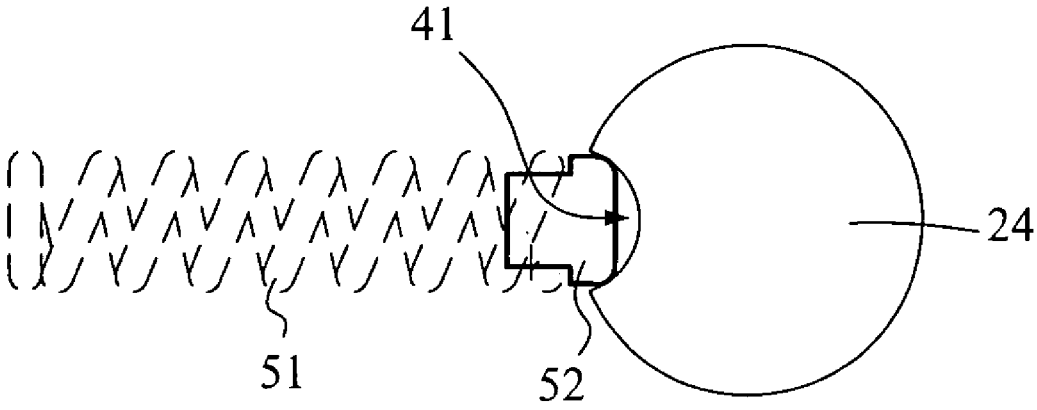
Figure 5C:
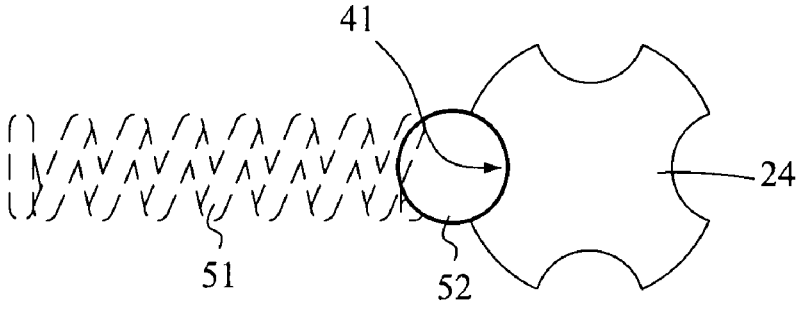
Figure 5D:
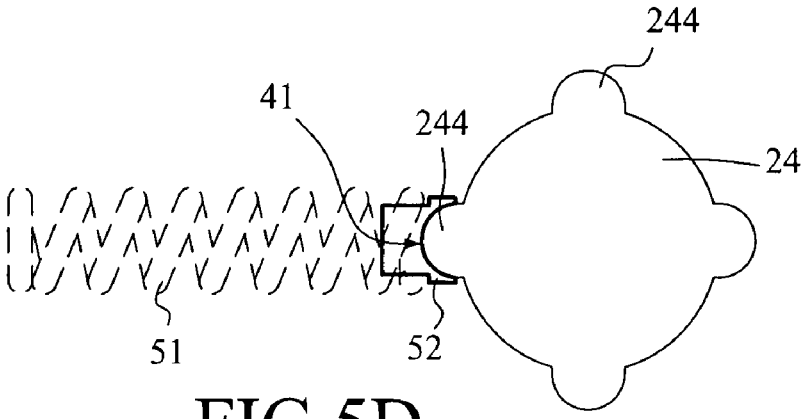
Figure 5E:
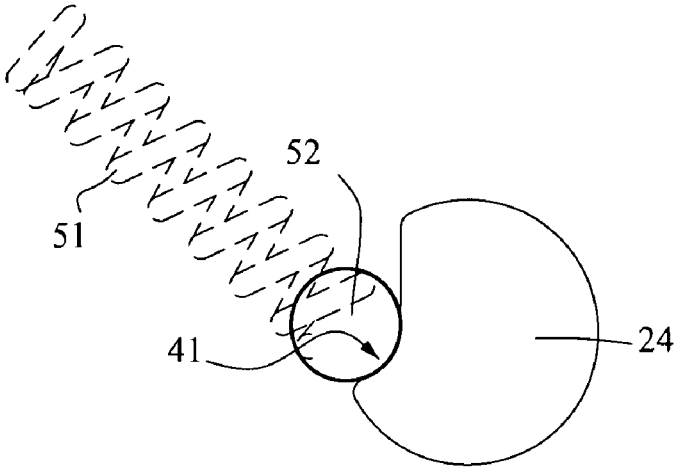

FIGS. 5A to 5E illustrate variations of the resilient member made according to the present invention. The inserted element 52 is formed in the shape of a cone (thereby forming the guided portion with an inclined plane on a top thereof) as shown in FIG. 5A, while the indented positioning portion 41 has a square-shaped cross-section, while the inserted element 52 is a cuboid having a lead angle as shown in FIG. 5B. Referring to FIG. 5C, a plurality of the indented positioning portions 41 are formed upon the driving shaft 24 to create more fixed angles. Referring to FIG. 5D, the indented positioning portion 41 of the driving shaft 24 is constituted into a protruded part 244 such that the inserted element 52 is transformed into a shallow indented portion. Referring to FIG. 5E, the elastic element 51 and the inserted element 52 are formed into an oblique angle, thus forming an indented positioning portion 41 in conjunction with the driving shaft 24.

Figure 6A:
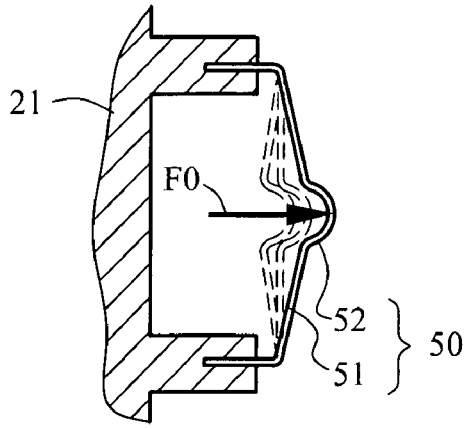
FIG. 6A is a view illustrating a resilient member made according to a second embodiment of the present invention.

FIG. 6A is a view illustrating a resilient member made according to a second embodiment of the present invention. The elastic element 51 of the resilient member 50 in the shape of a spring and the inserted element 52 integrated in the form of a protrusion on the spring respectively replace the spring and bearing ball in the previous embodiments. The spring is fixed on the first housing 21 at two ends thereof, to support the deformation under the operation of an external force as shown in FIG. 6A, thereby producing a force F0.

Figure 6B:
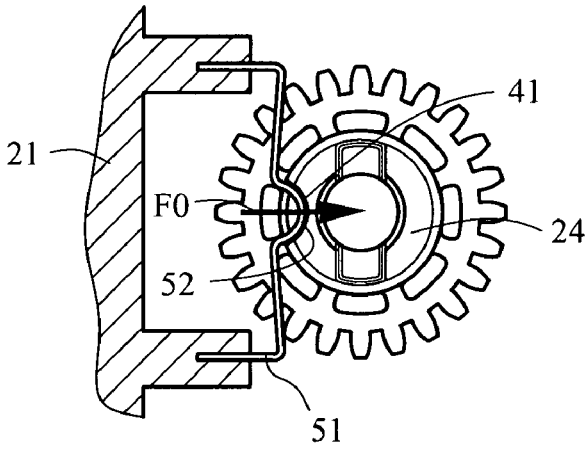
FIG. 6B and FIG. 6C are schematic views illustrating the structure and the function of a resilient member made according to the second embodiment of the present invention.
Figure 6C:
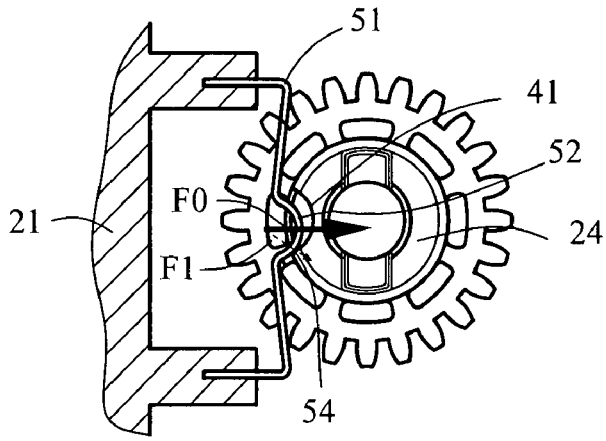

FIG. 6B and FIG. 6C are schematic views illustrating the function of a resilient member made according to the second embodiment of the present invention. In FIG. 6B, the protrusion on the spring exactly fits into the indented positioning portion 41 of the driving shaft 24. Given the force F0 acted upon by the protrusion perpendicular to the center of rotation of the driving shaft 24, the driving shaft 24 is maintained at a steady state as soon as it rotates to a specific angle. When the driving shaft 24 rotates to approach to the specific angle (in the location as shown in FIG. 6C), the force F0 produces a component of force F1 due to the force F0 acted by the protrusion on a contact point 54 at a corner of the indented positioning portion 41 as well as the angle of deflection between the contact point 54 and the force F0. At that instant, the driving shaft 24 is made to rotate to approach to a stable positioning state as shown in FIG. 6B. In other words, when the driving shaft 24 rotates to approach a specific angle, the resilient member 50 forces the driving shaft 24 to continue rotating until it reaches a stable location for positioning.

Figure 7A:
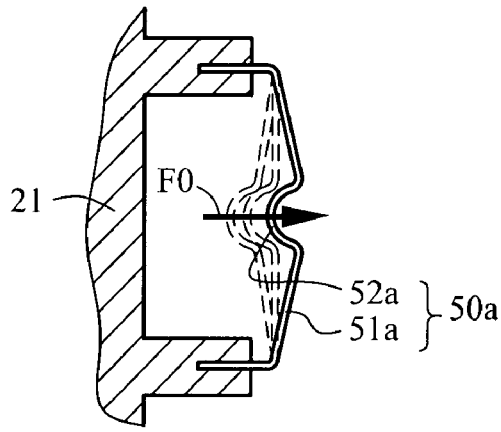
FIG. 7A is another embodiment illustrating variations of an elastic element in the resilient member made according to the second embodiment of the present invention.

FIG. 7A is another embodiment illustrating variations of an elastic element in the resilient member made according to the second embodiment of the present invention. In FIG. 7A, the elastic element 51*a* of the resilient member 50*a* in the shape of a spring and the inserted element 52*a* integrated in the form of an indented opening on the spring, respectively replace the spring and the bearing ball as shown in the first embodiment. The spring is fixed on the first housing 21 at two ends thereof, in order to support the deformation under the operation of an external force as shown in FIG. 7A, thereby producing a force F0. The indented positioning portion 41 on a circumference of the driving shaft 24 is formed into a protrusion corresponding to the indentation.

Figure 7B:
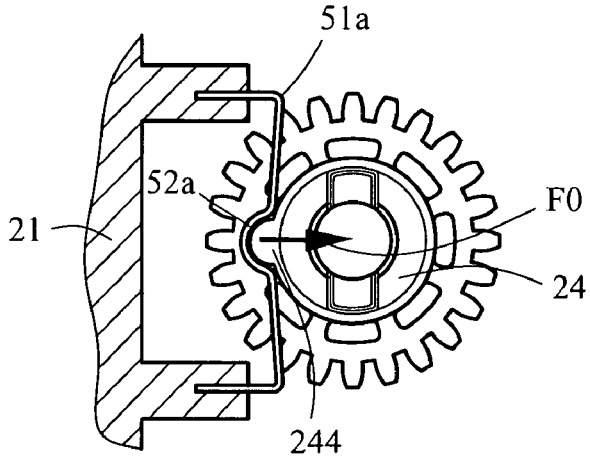
FIG. 7B and FIG. 7C are schematic views illustrating variations in the structure and the function of an elastic element in the resilient member made according to the second embodiment of the present invention.
Figure 7C:
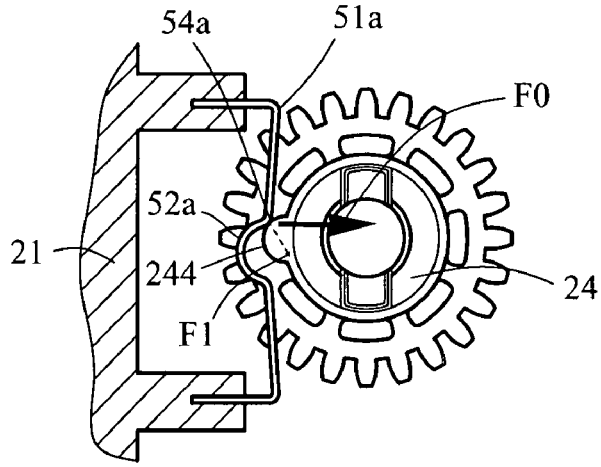

FIG. 7B and FIG. 7C are schematic views illustrating variations in the function of an elastic element in the resilient member made according to the second embodiment of the present invention. In FIG. 7B, the inserted element 52*a* on the spring exactly fits into the positioning portion 41 of the protruded part 244 of the driving shaft 24. Given the force F0 acted upon by the inserted element 52*a* toward the center of rotation of the driving shaft 24, the driving shaft 24 is steadily formed into a specific angle. When the driving shaft 24 rotates to approach to the specific angle (in the location as shown in FIG. 7C), the force F0 of the inserted element 52*a* pushes against a contact point 54*a* on a circumference of the driving shaft 24 near the positioning portion 41. The contact point 54*a* makes an angle of deflection with the force F0, such that the force F0 produces a component of force F1, driving the driving shaft 24 to rotate and reach a stable positioning state as shown in FIG. 7C. In other words, when the driving shaft 24 rotates to approach the specify angle, the resilient member 50*a* forces the driving shaft 24 to continue rotating to a steady location for positioning.

The present embodiment is formed into an indented positioning portion 41 or a protruded part 244 of a driving shaft 24, such that the driving shaft 24 is horizontally extended. For practical applications, the driving shaft 24 is formed relative to more than two positioning portions with a predetermined angle with the axis of the driving shaft. For example, one angle makes the louver blade 30 in a closed position while another angle makes the louver blade 30 horizontally open. Given this structure, when the louver blade 30 is manually or electrically rotated to approach the specific angle, the louver blade 30 automatically approaches the specific angle and becomes positioned, thereby overcoming the drawback of having clearance between the motor and the transmission mechanism. In this way, the louver blade is maintained manually closed or a plurality of the louver blades of the motorized shutter assembly can easily become positioned at a specific angle by motorized or manual operations. The aforesaid positioning portion and the inserted element can be formed on a driving shaft (for example, the transmission mechanism) outside the driving shaft 24. Moreover, the present invention can be applied for slats positioning of conventional blind products too.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A motorized shutter assembly with a louver blade positioning device, comprising:

a module, incorporating a motor and a transmission mechanism, for being mounted on a shutter assembly;

a driving shaft, driven by said motor and said transmission mechanism, for driving a louver blade of said shutter to rotate about a predetermined axis of which a circumference thereof provided with at least a positioning portion;

a resilient member, provided on said shutter assembly and provided with an inserted element capable of being inserted into said positioning portion such that said inserted element provides a force, and a direction of said force forms a predetermined angle with an axis of said driving shaft; and a guided portion, disposed between said positioning portion and said inserted element, such that when said driving shaft with said positioning portion is rotated and stopped approaching a specific angle, said resilient member therefore forces said driving shaft to rotate to said specific angle through said guided portion; and said force further maintains said positioning portion and said inserted element being positioned relative to one another after approaching said specific angle.

2. The motorized shutter assembly with a louver blade positioning device as claimed in claim 1, wherein said positioning portion of said driving shaft is constituted in a form of an indentation.

3. The motorized shutter assembly with a louver blade positioning device as claimed in claim 2, wherein said resilient member comprises a bearing ball and a spring.

4. The motorized shutter assembly with a louver blade positioning device as claimed in claim 2, wherein said resilient member is a spring.

5. The motorized shutter assembly with a louver blade positioning device as claimed in claim 1, wherein said positioning portion formed upon said driving shaft is a protrusion.

6. The motorized shutter assembly with a louver blade positioning device as claimed in claim 5, wherein said resilient member is a spring.

7. The motorized shutter assembly with a louver blade positioning device as claimed in claim 1, wherein a circumference of said driving shaft is provided with at least two positioning portions.

8. The motorized shutter assembly with a louver blade positioning device as claimed in claim 1, wherein said direction of said force forms an oblique angle with an axis of said driving shaft.

9. The motorized shutter assembly with a louver blade positioning device as claimed in claim 1, wherein an orientation of said force is perpendicular to an axis of said driving shaft.

10. The motorized shutter assembly with a louver blade positioning device as claimed in claim 1, wherein said guided portion is either in a form of an arc or an inclined plane arranged upon said positioning portion or said inserted element.

* * * * *